US005247956A

United States Patent [19]

Vincent

[11] Patent Number: 5,247,956

[45] Date of Patent: Sep. 28, 1993

[54] GALE-PROOF UMBRELLA WITH CANOPY INVERTING AND RESTORING MECHANISM

[76] Inventor: William B. Vincent, 426 St. Lawrence Ave., New York, N.Y. 10473

[21] Appl. No.: 816,038

[22] Filed: Dec. 30, 1991

[51] Int. Cl.[5] ..... A45B 25/00

[52] U.S. Cl. ..... 135/29; 135/31

[58] Field of Search ..... 135/15.1, 16, 20.3, 135/31, 29, 27

[56] References Cited

U.S. PATENT DOCUMENTS

| | | | |
|---|---|---|---|
| 864,945 | 9/1907 | Bigelow | 135/31 X |
| 874,648 | 12/1907 | Wolfe | 135/31 |
| 1,429,828 | 9/1922 | Baker | 135/28 |
| 2,788,792 | 4/1957 | Koller | 135/31 X |
| 3,277,909 | 10/1966 | Militano | 135/28 |
| 3,643,673 | 2/1972 | Weber | 135/28 X |
| 5,020,557 | 6/1991 | Apple | 135/28 X |

FOREIGN PATENT DOCUMENTS

| | | | |
|---|---|---|---|
| 672139 | 9/1929 | France | 135/31 |

*Primary Examiner*—Carl D. Friedman
*Assistant Examiner*—Lan M. Mai
*Attorney, Agent, or Firm*—Robert W. J. Usher

[57] ABSTRACT

A folding umbrella for use in extremely gusty conditions includes spreaders extending between canopy supporting ribs and the umbrella pole which are longitudinally extensible against the action of a spring. The ribs and the spreader are linked to the pole for pivotal movement through one hundred and eighty degrees permitting a strong gust of wind to invert the canopy to extend with the spreaders above the pole thereby spilling the wind. The spreaders include cylinders formed by tubes receiving a helical compression spring and one end of each spreader is formed as a piston rod extending through the spring and having a head at the other end trapping the spring against an end of the tube.

4 Claims, 2 Drawing Sheets

GALE-PROOF UMBRELLA WITH CANOPY INVERTING AND RESTORING MECHANISM

FIELD OF THE INVENTION

The invention relates to umbrellas and particularly to an umbrella which can spill the wind on very gusty days by inversion of the canopy.

BACKGROUND OF THE INVENTION

There have been many prior attempts to design umbrellas which can be used in gusty conditions without risk of damage.

Umbrellas having compression springs mounted on the pole between the slider and an upper crownpiece from which the ribs extend are well known and commonly used. Although the springs provide a cushioning, upper stop or buffer which permits the canopy and ribs very limited upward movement as a whole in response to the force of a strong wind, controlled displacement of the canopy and the ribs as a whole above the horizontal, rain shedding position and, therefore, inversion of the canopy to spill the wind is not possible while the entire spring must be overcome to permit upward movement of even a single rib so that upward movement of only a portion of the canopy to relieve unevenly distributed wind stress is not possible.

Some other prior attempts have been directed to the prevention of inversion of the umbrella canopy, often by the provision of one or more canopies having wind escape apertures to prevent inversion.

In one prior approach taught by U.S. Pat. No. 4,979,534 to Johnson, upper and lower canopies have wind venting apertures formed therein, the upper canopy being secured by elastic members on the lower canopy covering the wind venting apertures thereof so that a wind upthrust will be vented through the lower apertures raising the upper canopy away from the lower canopy to expose the venting apertures in the upper canopy thereby releasing the wind force, the raising movement being accommodated by resilient flexure of the elastic members.

SUMMARY OF THE INVENTION

The present invention seeks to provide an umbrella which avoids risk of damage to the canopy in extremely gusty conditions by providing for inversion of the canopy.

According to the invention, in a folding umbrella of the kind comprising a series of canopy supporting ribs pivotally mounted to a pole and a series of spreaders pivotally linking respective ribs with a pole slider for erecting the ribs and canopy to a horizontal, rain-shedding position, the spreaders are longitudinally extensible and resilient means are provided to restore the spreaders to their unextended length, the spreaders and ribs being linked to the pole for pivotal movement through one hundred and eighty degrees such that an upthrust of wind on the canopy can pivot the spreaders and ribs upwardly above the pole to extend substantially in line therewith permitting inversion of the canopy to spill the wind, the restoring force of the resilient means returning the ribs in the canopy to the horizontal rain-shedding position when the wind force drops.

Thus, the canopy can be inverted to spill the wind in a controlled manner determined by the strength of the resilient means while retaining the canopy secured to the frame structure of the umbrella.

Preferably, at least some of the spreaders comprise first and second end portions pivotally linked to the slider and ribs, respectively, the resilient means comprising a spring interconnecting the first and second end portions.

In a particularly advantageous embodiment, at least some of the spreaders comprise tubes each attached at one axial end to one end portion one of the said at least some spreaders and the resilient means comprises a coil compression spring mounted in each tube, the other end portion of each of said at least some spreaders comprising a piston rod mounted for longitudinal sliding movement through the other end of the tube extending through the spring and having a piston head or cap trapping the spring against the other end of the tube, compression of the spring by the piston head enabling extension of the spreader.

A buffer may be inserted in the one end of the tube for cushioning abutment by the piston head during return of the spring from a compressed to uncompressed condition.

Thus, the umbrella of the invention is a mechanism with a predictable, machine like precision.

BRIEF INTRODUCTION TO THE DRAWINGS

A specific embodiment of the invention will now be described with reference to the accompanying drawings in which.

Figures 1, 3:
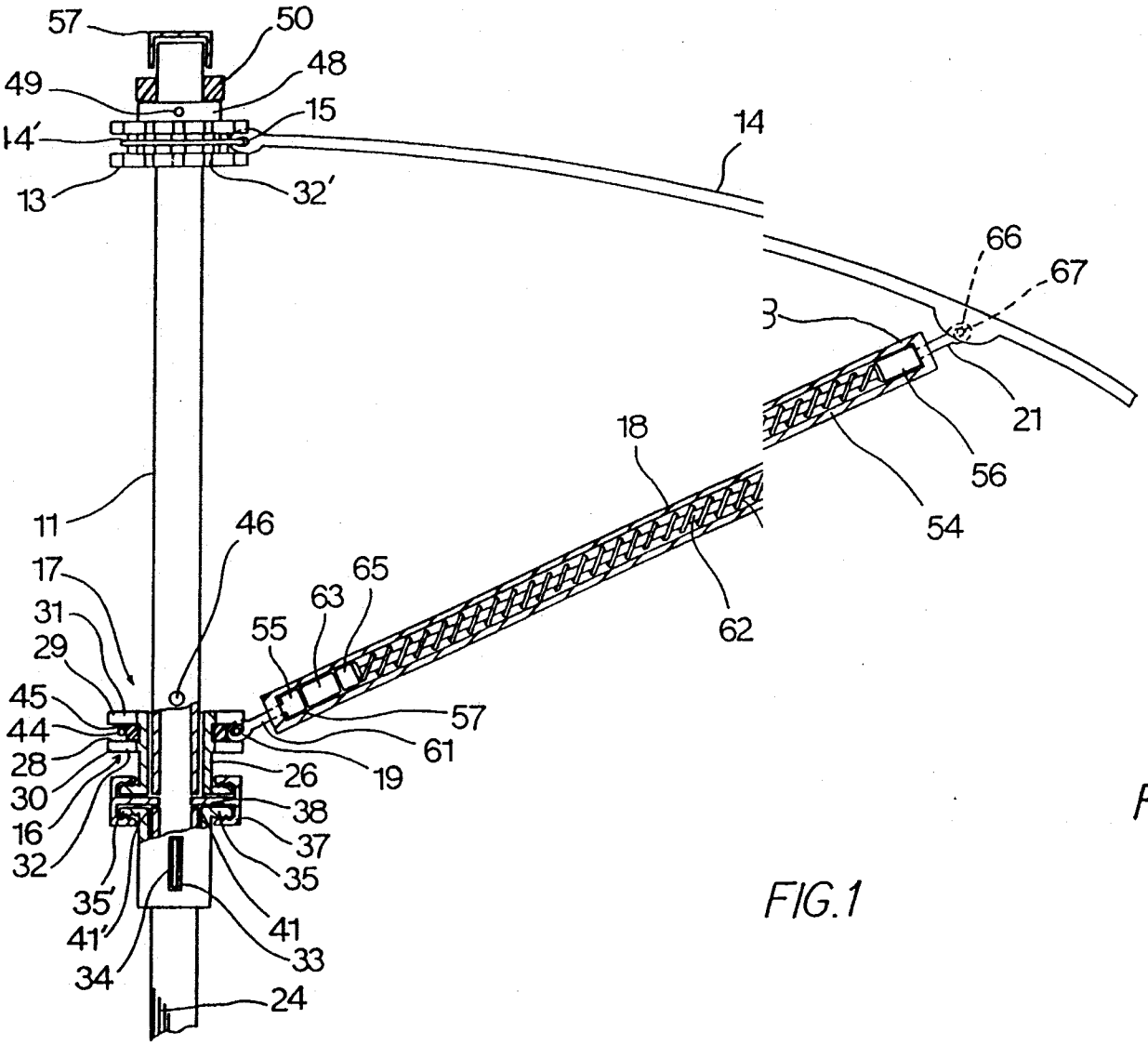
FIG. 1 is a schematic view, partly in cross-section of a part of the umbrella mechanism in a rain shedding position.

The umbrella comprises a pole 11 with a handle 12 at a lower end; a hub-like crown-piece 13 at an upper end to which canopy supporting ribs 14 are pivotally connected at one of their ends 15; and, a slider 16, also formed with a crown-piece 17 to which spreaders 18 are pivotally connected at one of their ends 19, other ends 21 of the spreaders being pivotally connected to respective ribs at medial locations thereof.

Figure 2:
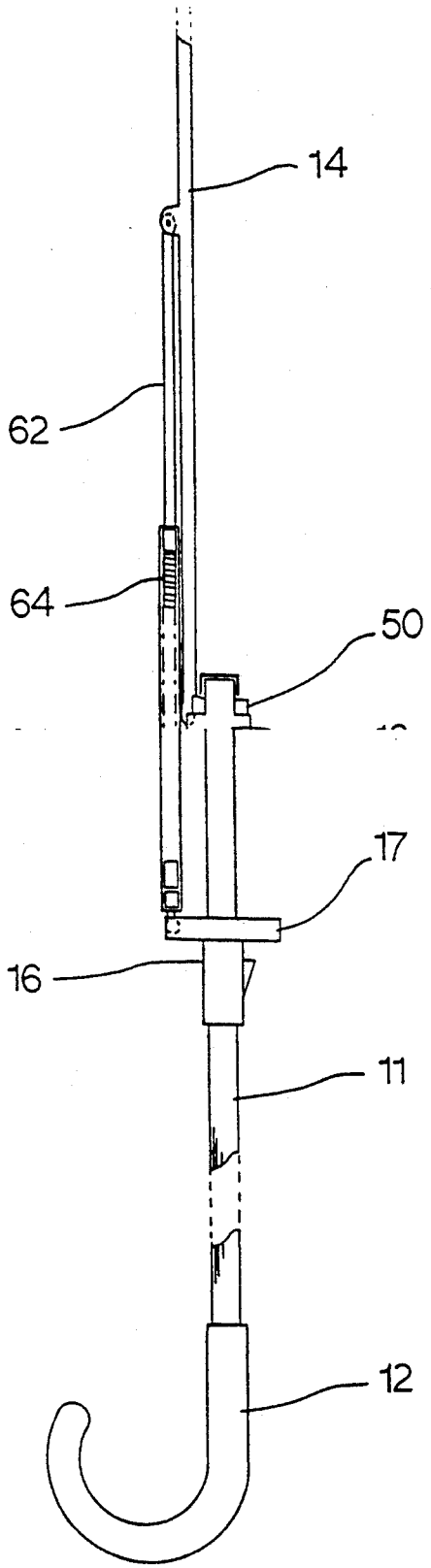
FIG. 2 is a schematic view of the mechanism in an extreme wind spilling position; and, FIG. 3 is a schematic cross-sectional view showing a modified rib of increased strength.
Figures 1, 3:
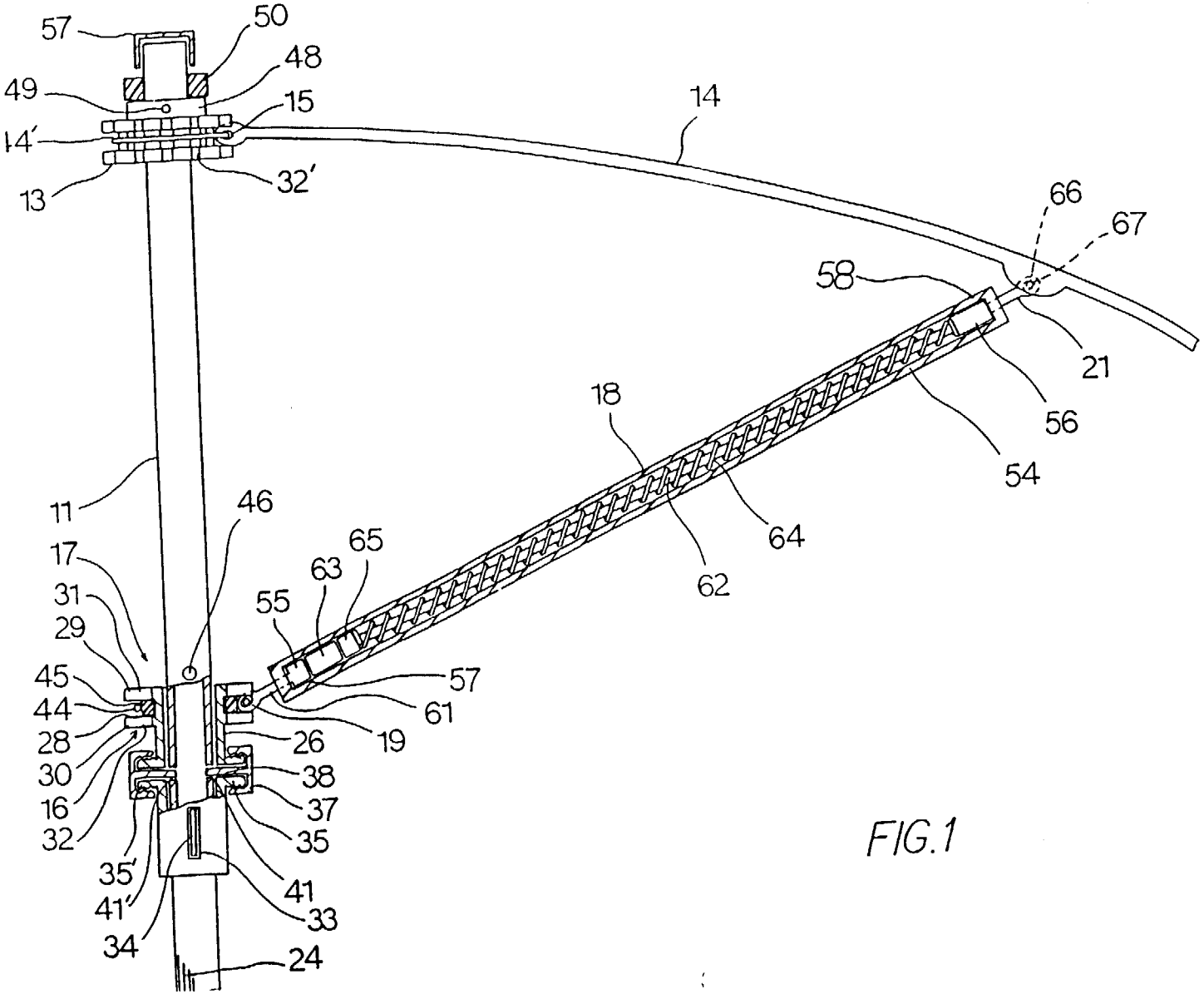

The slider 16 is moveable along the pole in conventional manner between lower, collapsed or folded positions adjacent the handle 12 and an upper, erect, rain-shedding position shown in FIG. 2, adjacent, but at a predetermined spacing from, the crown-piece 13, the spreaders moving the ribs 14 upwardly and outwardly to stretch the canopy in taut, dome-shape condition in a horizontal, rain shedding position extending at 90° to the pole.

The pole 11 is a hollow cylinder formed from corrugated metal providing longitudinally extending tracks 24 on an outer surface for interdigitation with castellations (not shown) machined on the inner surface of the slider for accurately guiding the slider movement.

The slider 16 is a machined metal part comprising a sleeve 26 with the crown piece 17 formed as a hub extending from an upper end thereof and having a encircling groove 28 defined between upper and lower, parallel, circular flanges 29 and 30, respectively, formed with series of aligned, radially extending spreader-receiving slots 31 and 32, respectively, at circumferencially spaced apart, locations. A vertical slot 33 is formed in the slider adjacent the lower end thereof for receipt of a conventional, over-rideable sprung catch 34 mounted on the pole to latch the slider in the upper position in conventional fashion and a pair of radially outwardly extending externally threaded locking tubes 35 and 35', respectively, are formed at locations between the slot and the crown-piece. A slider locking element comprising an internally threaded cap 37, carrying an axially extending locking spigot 38 therein is threadably mounted on each tube for manual rotation towards the pole from an outer, slide release position to an inner, slide locking position in which the spigots are securely locking the slider in the uppermost position received in respective locking apertures 41 and 41' formed at diametrically opposite locations in the pole.

A circular metal pivot ring 44, formed from a wire loop, is located extending around the groove maintained at a predetermined spacing from the base thereof by a series of rubber or plastic spacers 45 positioned at the base of the grooves between respective slots.

A cross bolt 46 is secured through the pole at a location adjacent but spaced above the locking apertures providing a stop limiting upward movement of the slider.

The upper, rib-supporting crown-piece 13 is of similar construction to the spreader-supporting crown-piece 17 and will not, therefore, be further described, except that upper, rib-supporting crown-piece 13 is integrally formed with an upwardly extending sleeve part 48 secured to the pole by a cross-pin 49.

A resilient rib cushioning bush 50 of elastomeric material is mounted on the sleeve.

The canopy (not shown) is of conventional, circular, sheet-form, secured as a central location to the tip of the pole in known manner, e.g., by trapping under a metal cap 57 crimped, screw threaded, or otherwise fastened thereon and at intervals around the outer periphery to eyes formed on outer ends of respective ribs.

Each spreader comprises a rigid plastic tube 54 stopped, for example, by adhesive or filling compound 55, 56 at opposite ends 57, 58, the inner end 57 being formed with an internal groove or thread (not shown) in which one end of a pivotal link 61 of the spreader is anchored, for example, by adhesive, the other end 19 of the link 61 being formed with an eye receiving the ring thereby pivotally connecting the spreader to the crown-piece 17 of the slider 16. A piston rod 62 extends slidably through the other, stopped end trapping a compression spring 64 between a piston head or cap 65, adjacent the pole and the other stopped end for free resilient compression of the spring within the tube. The piston rod is formed at the other end with an eye 66 securing it to a clevis pin 67 formed in the rib. An elastomeric pad 63 forming a buffer or cushion for the piston head 65 is mounted in the inner end of the tube 54.

In operation of the umbrella, the canopy is erected to a rain-shedding position by pushing the slider 16 up the pole 11 until the catch 34 registers in the slot 33 therein and the crown-piece 17 engages the stop bolt 46, preventing further upward movement of the slider, in which position the locking spigots 38 are aligned with respective locking apertures in the pole 11. The caps 37 are then screwed home to securely fix the slider to the pole.

In the normal, horizontal rain-shedding position, the spreaders 18 act as struts bracing the ribs outwardly to maintain the canopy in taut, dome-like shape, the compressive force being taken by the piston rods 62 engaging the buffer and by the tubes 54. In this position, the spring 64 is fully extended.

The force of a powerful gust of wind blowing under the canopy will cause the entire canopyor portions thereof to lift, permitted by progressive compression of the springs 64 with associated upward pivotal movement of the ribs 14 extending the spreaders 18. However, upward movement of the slider 17 is prevented by engagement with the bolt 46.

If the wind force is sufficiently strong, the ribs 14 will be pivoted to upstand coaxially above the pole, having rotated one hundred and eighty degrees from the collapsed or folded position of the umbrella, with inversion of the canopy enabling the umbrella to spill the wind to prevent damage to the canopy. In the final stages of movement, the ribs are cushioned by abutment with the rubber bush 50.

When the wind drops, the restoring force of the springs 64 will immediately return the canopy, spreaders and ribs to the normal, dome-shape, rain-shedding position, the impact of the piston head on the inner end of the tube 54 being cushioned by the respective buffers 63.

It will be appreciated that the strength of the springs can be selected according to the size and strength of the canopy material as can materials for other components. For example, the eye forming and other structures may be reinforced by liners such as rivets.

It will be apparent that the umbrella of the invention is both extremely strong and efficient in its wind spilling capacity permitting controlled inversion of only part of the canopy in response to wind stress unevenly distributed thereon so that even on a an extremely gusty day risk of damage to the canopy material and other structures is minimized.

In the modification shown schematically in FIG. 3, ribs of increased strength and thickness comprise metal strip portions formed into two U-shaped channel sections attached together in base-to-base relation providing equal flexural characteristics in both upward and downward directions.

I claim:

1. A folding umbrella of the kind comprising a series of canopy supporting ribs pivotally linked to a pole and a series of spreaders pivotally linking respective ribs with a pole slider for erecting the ribs and canopy to a horizontal rain-shedding position, the improvement residing in that at least some of the spreaders comprise first and second end portions pivotally linked to the slider and ribs, respectively, and are longitudinally extensible and spring means interconnect respective first and second end portions to restore the spreaders to their unextended lengths and in that the spreaders and ribs are pivotally linked to the pole for pivotal movement through one hundred and eighty degrees such that an upthrust of wind on the canopy can pivot the spreaders and ribs upwardly with extension of the spreaders above the pole to extend substantially in line therewith permitting inversion of the canopy to spill the wind, the restoring force of the spring means returning the ribs and the canopy to the rain-shedding position when the wind force drops.

2. An umbrella according to claim 1 in which at least some of the spreaders comprise tubes each attached at one axial end to one end portion one of the said at least some spreaders and the resilient means comprises a coil compression spring mounted in each tube, the other end portion of each of said at least some spreaders comprising a piston rod mounted for longitudinal sliding movement through the other end of the tube extending through the spring and having a piston head trapping the spring against the other end of the tube, and compression of the spring by the piston head enabling extension of the spreader.

3. An umbrella according to claim 2 in which a buffer is inserted in the one end of the tube for cushioning abutment by the piston head during return of the spring from a compressed to uncompressed condition.

4. An umbrella according to claim 1 in which at least some of the ribs comprise metal strip portions formed into two U-shaped channel sections attached together in base-to-base relation.

* * * * *

UNITED STATES PATENT AND TRADEMARK OFFICE

CERTIFICATE OF CORRECTION

PATENT NO. : 5,247,956

DATED : September 28, 1993

INVENTOR(S) : Vincent

It is certified that error appears in the above-indentified patent and that said Letters Patent is hereby corrected as shown below:

Drawing sheet 2 should be deleted to appear as per attached drawing sheet 2.

Signed and Sealed this

Third Day of May, 1994

Bruce Lehman

*Attest:*

BRUCE LEHMAN

*Attesting Officer*

*Commissioner of Patents and Trademarks*